US007311291B2

(12) United States Patent
Robinson

(10) Patent No.: US 7,311,291 B2
(45) Date of Patent: Dec. 25, 2007

(54) MAILBOX SUPPORT POST

(75) Inventor: Larry Dwight Robinson, Taylorsville, MS (US)

(73) Assignee: Solar Group, Inc., Taylorsville, MS (US)

( * ) Notice: Subject to any disclaimer, the term of this patent is extended or adjusted under 35 U.S.C. 154(b) by 249 days.

(21) Appl. No.: 11/030,031

(22) Filed: Jan. 6, 2005

(65) Prior Publication Data

US 2006/0145048 A1 Jul. 6, 2006

(51) Int. Cl.
*A01K 97/10* (2006.01)
*A47G 29/12* (2006.01)

(52) U.S. Cl. ..... 248/533; 248/545; 52/156; 232/39

(58) Field of Classification Search ..... 248/533, 248/530, 545, 156, 532, 159, 146; 52/156, 52/154, 165, 163, 167.1, 153; 232/39; 403/274, 403/279, 281, 319, 388; 256/65.14, DIG. 5
See application file for complete search history.

(56) References Cited

U.S. PATENT DOCUMENTS 1,281,062 A * 10/1918 Norvell ..... 248/146
1,717,557 A * 6/1929 Halgrimson ..... 52/153
2,149,050 A * 2/1939 Hajicck ..... 248/145
2,993,671 A * 7/1961 Knebusch ..... 248/87
3,011,598 A * 12/1961 Galloway et al. ..... 52/153
4,403,730 A * 9/1983 Batson ..... 232/39
4,843,746 A * 7/1989 DesNoyers et al. ..... 40/607.04
4,867,421 A * 9/1989 Vernon ..... 256/54
4,955,533 A * 9/1990 Merkel ..... 232/39
5,050,828 A * 9/1991 Wolff ..... 248/156
5,058,337 A * 10/1991 O'Connor ..... 52/162
5,082,231 A * 1/1992 Knowles ..... 248/545
5,608,994 A * 3/1997 Carter ..... 52/156
5,713,514 A * 2/1998 Eck ..... 232/39
5,947,306 A * 9/1999 Chang ..... 211/85.23
6,343,446 B1 * 2/2002 Beard ..... 52/165

* cited by examiner

*Primary Examiner*—Anita M. King
(74) *Attorney, Agent, or Firm*—David P. Maivald; Arnold B. Silverman; Eckert Seamans Cherin & Mellott, LLC

(57) ABSTRACT

An elongated support post for a mailbox has a mailbox support arm secured to an upper portion of the support post and at least one anchor fin secured to a lower portion of the support post and projectingly outwardly therefrom. In one embodiment of the invention a pair of support fins is secured to generally opposed portions of the support post and project radially outwardly therefrom. The support post may have openings into which portions of the support fins extend for mechanical interengagement therebetween. The support fins are preferably taperedly downwardly so as to facilitate insertion of the post into the earth.

16 Claims, 5 Drawing Sheets

MAILBOX SUPPORT POST

BACKGROUND OF THE INVENTION

1. Field of the Invention

The present invention relates to a mailbox support post such as a post employed for a rural mailbox and, more specifically, it relates to such a post having ground engaging fins projecting outwardly from a lower portion of the support post.

2. Description of Background Art

It has been known in connection with rural type mailboxes which tend to be positioned adjacent to a road to provide a support post which is inserted into the ground and has a mounting arm secured to an upper portion of the post. A rural mailbox overlies and is supported by and secured to the mounting arm in such a manner that the hinged door which provides access to the mailbox interior faces the road.

The fabricated mailbox support posts are generally hollow, circular or square, tubular metal posts which may be a single, one-piece tube assembled from two or more tube components joined to each other. It has also been known to employ wooden or plastic posts for such purposes.

It is important that the mailbox supporting post be firmly anchored with a generally vertical orientation so as to support the weight of the mailbox as well as contents that may be placed therein and to resist movement when forces are applied to the mailbox door to open or close the same. Such posts are generally either inserted into the ground to a sufficient depth to establish the desired stability or may have stabilizing material such as gravel or concrete surrounding the post or posts anchor device provided under the surface of the soil. Such mailboxes also have to resist natural forces such as wind, rain and snow, any of which can tend to weaken the securement and move the mailbox support post out of its desired vertical orientation.

In spite of the known systems there remains a need for providing an enhanced means for stabilizing such mailbox support posts in order to provide more reliable structural performance.

SUMMARY OF THE INVENTION

The present invention has met the above described need by providing a mailbox support post which has a mailbox support onto which the mailbox is secured to an upper portion of the post with at least one anchor fin secured to a lower portion of the post and projecting radially outwardly therefrom.

In one embodiment of the invention, a pair of generally radially oriented fins is disposed on generally opposite sides of a lower portion of the mailbox support post and project radially outwardly therefrom. The fins may taper downwardly to provide for more efficient entry of the post and anchor fins into the earth.

In one preferred embodiment, mechanical securement of the fins to the mailbox post is effected by providing a pair of openings in the post with a pair of cooperating projecting fingers of the fins extending into such openings and interengaging the portions of the post disposed adjacent thereto.

It is an object of the present invention to provide a mailbox support post which is structured to enhance stability of the mailbox-post assembly when it is inserted into the earth.

It is a further object of the present invention to provide such a mailbox support post wherein resistance to undesired rotational movement of the post is provided.

It is yet another object of the present invention to provide a stabilizing structure for a mailbox support post which is economical to employ and easy to secure to the mailbox post.

It is a further object of the present invention to provide anchor fins which are mechanically secured to a mailbox post and are configured so as to facilitate insertion of the assembly into the earth.

These and other objects of the invention will be more fully understood from the following detailed description of the invention on reference to the illustrations appended hereto.

DESCRIPTION OF THE PREFERRED EMBODIMENTS

As employed herein, the term "earth" means the support material into which the lower portion of the mailbox support post will be placed and expressly includes, but is not limited to, soil, gravel, concrete and combinations thereof.

Figure 1:
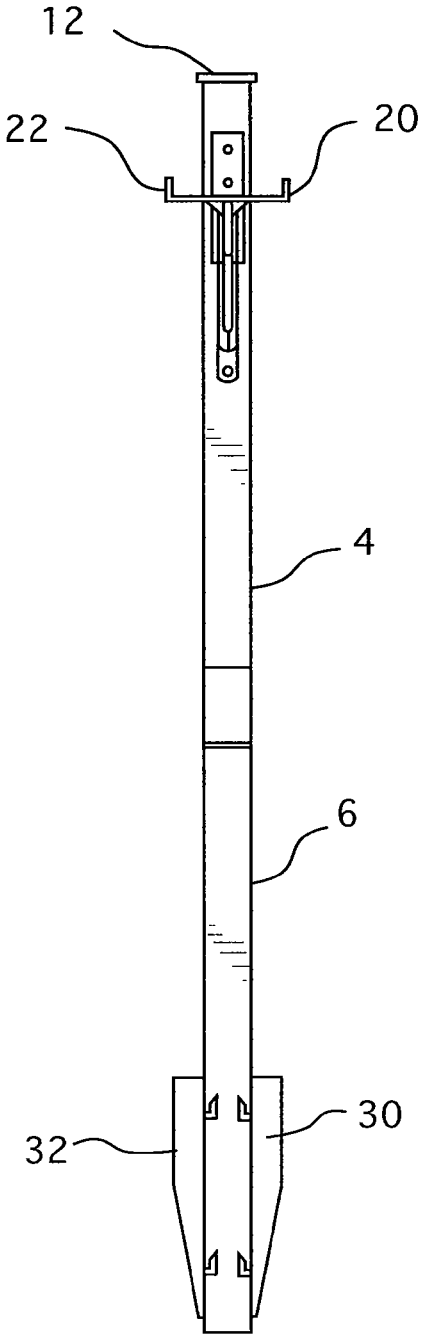
FIG. 1 is a front elevational view of a form of mailbox support of the present invention without illustrating the mailbox which will be supported thereon.
Figure 2:
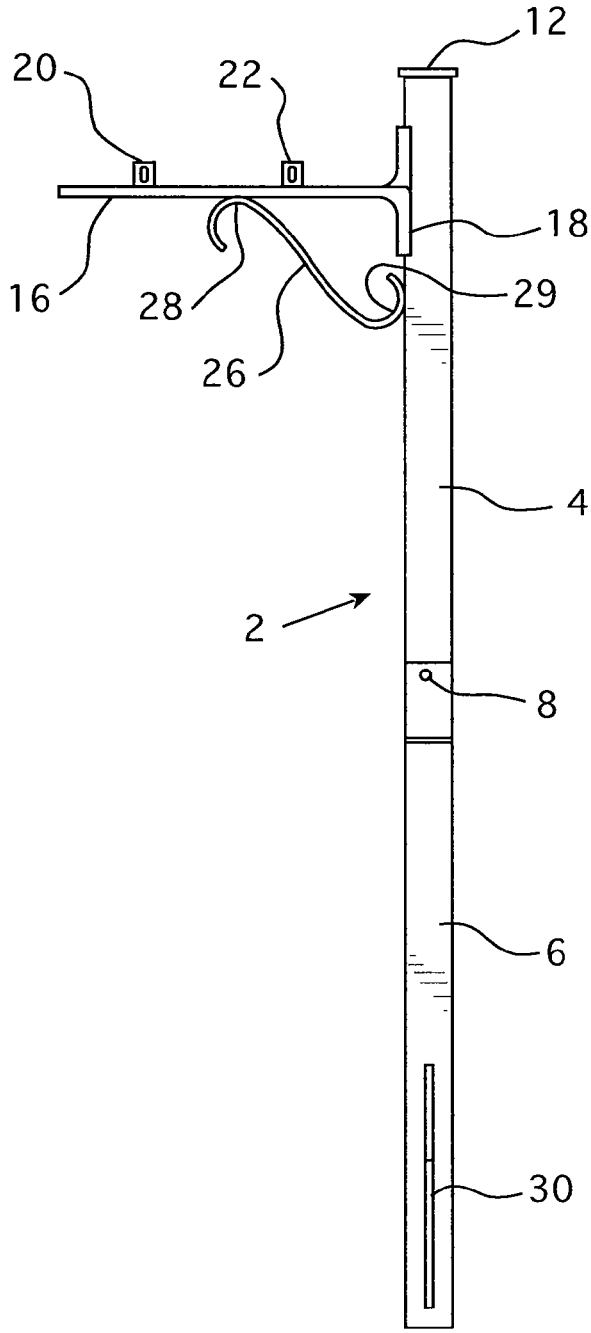
FIG. 2 is a right side elevational view of a mailbox support post of FIG. 1.
Figure 3:
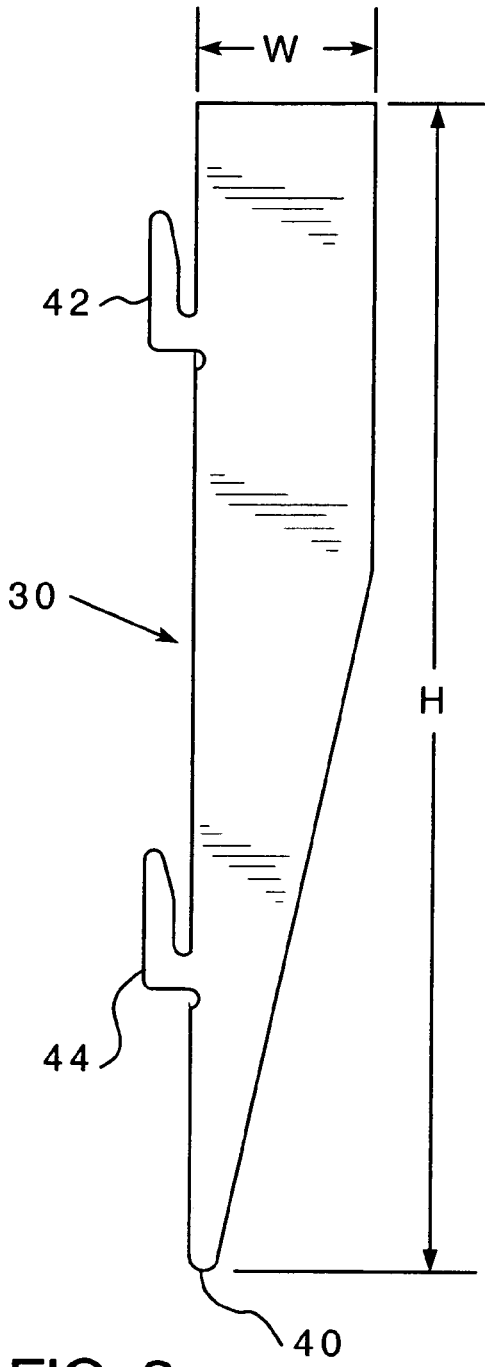
FIG. 3 is a front elevational view of a form of anchor fin employable with the mailbox post of the present invention.
Figure 4:
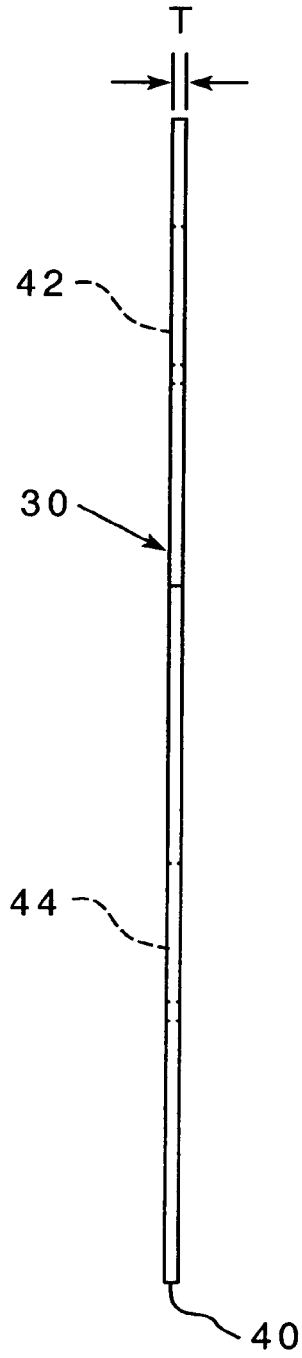
FIG. 4 is a right side elevational view of the mailbox fin of FIG. 3.

Referring to FIGS. 1 and 2, there is shown a support post 2 which in the form illustrated, has an upper post portion 4 secured to a lower post portion 6 as by mechanical fasteners 8 with the upper end of the lower post portion 6 received within the lower end of the upper post portion 4. A suitable cap 12 is secured to the uppermost portion of uppermost portion 4 of mailbox support post 2. A mounting arm 16 has a downwardly extending flange 18 and is secured to the mailbox support post 2 within the upper portion 4. The mounting arm 16 has a pair of L braces such as 20, 22 on each side of the mounting arm 16, as shown, in FIG. 1 being the first of two spaced L braces, one on each side. In the form shown, reinforcing bracket 26 is secured by a curved flange 28 in underlying supporting relationship with respect to mounting arm 16 and a curved flange 29 which is secured to upper support post portion 4. It will be appreciated that a rural mailbox may be positioned in overlying relationship to the mounting arm 16 by suitable mechanical fasteners. As will be apparent from the following disclosure this portion of the structure forms no part of the invention per se and alternate structures and alternate means of securing a rural mailbox to the support post will be known to those skilled in the art. Referring to FIGS. 1 and 2 secured to the lower portion 6 of the support post in the form shown is a pair of anchor fins 30, 32 which are positioned in generally radially outwardly projecting direction from the lower support post portion 6 to which they are mechanically secured. Referring to FIGS. 3 and 4 it will be seen that the fin has a height H which is preferably about 4 to 12 inches, a width at its upper portion W of about ½ to 3 inches and a thickness T of about 5⁄64 to 5⁄32 inch. The support post upper section 4 and lower section 6 are preferably made of metal or a high-strength thermoplastic material or a reinforced plastic with or without reinforcing metal inserts. Anchor fins 30, 32 are preferably made of metal or a high-strength thermoplastic or a reinforced plastic. The post sections 4, 6 need not be made of the same materials as the anchor fins 30, 32.

It will be seen as shown in FIG. 3 that the anchor fin tapers downwardly to a lower terminal end 40. A pair of generally upwardly projecting finger elements 42, 44 which are spaced from each other will serve to provide a preferred means for mechanically securing the anchor fin to the tubular lower support post section 6.

Figure 5:
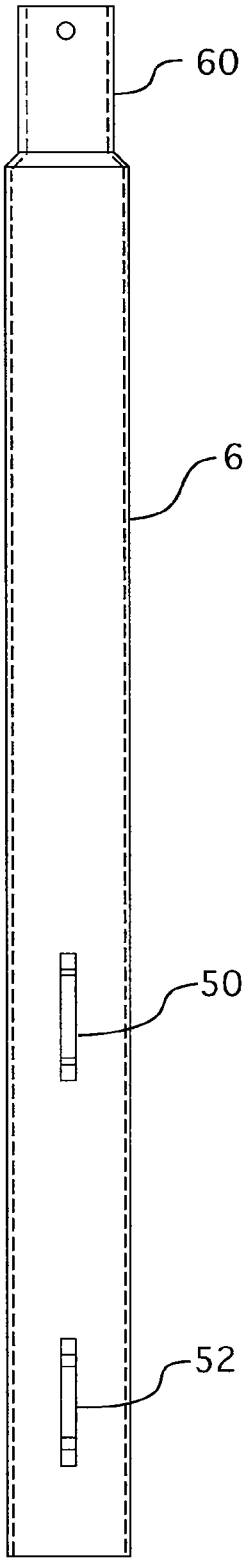
FIG. 5 is a right side elevational view of a lower portion of a support post of the present invention.
Figure 6:
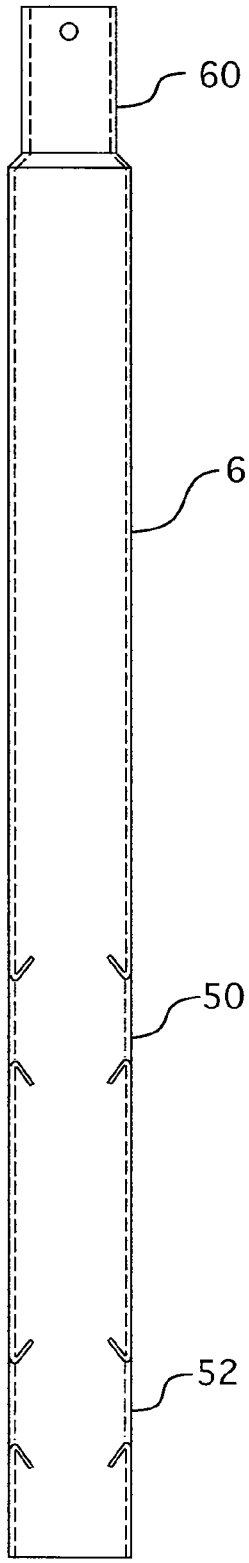
FIG. 6 is a right side elevation of the post of FIG. 5.
Figure 7:
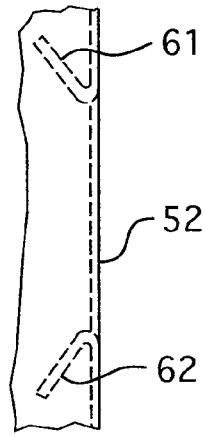
FIG. 7 is a fragmentary illustration showing an opening in a lower portion of a support post of the present invention.

Referring to FIGS. 5 and 6 it will be seen that the lower support portion 6 has a pair of elongated generally axially oriented slots 50, 52 into which the fingers 42, 44 of anchor fin 30 may pass thereby effecting mechanical interengagement therebetween. It will be seen in FIG. 7 that tab portions 61, 62 which are established when slot 52 is formed remain an integral part of the lower support member 6 and project generally inwardly.

Figure 8:
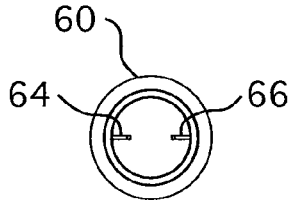
FIG. 8 is a top plan view of the lower post portion of FIG. 7.

FIG. 8 shows a top plan of the lower portion of the support with a necked-in upper portion 60 which is adapted to be telescopingly received within the upper portion 4 of the support member. Tabs 64, 66 which are formed in creating slots in tube 6 project inwardly to permit enhanced fin engagement.

Figure 9:
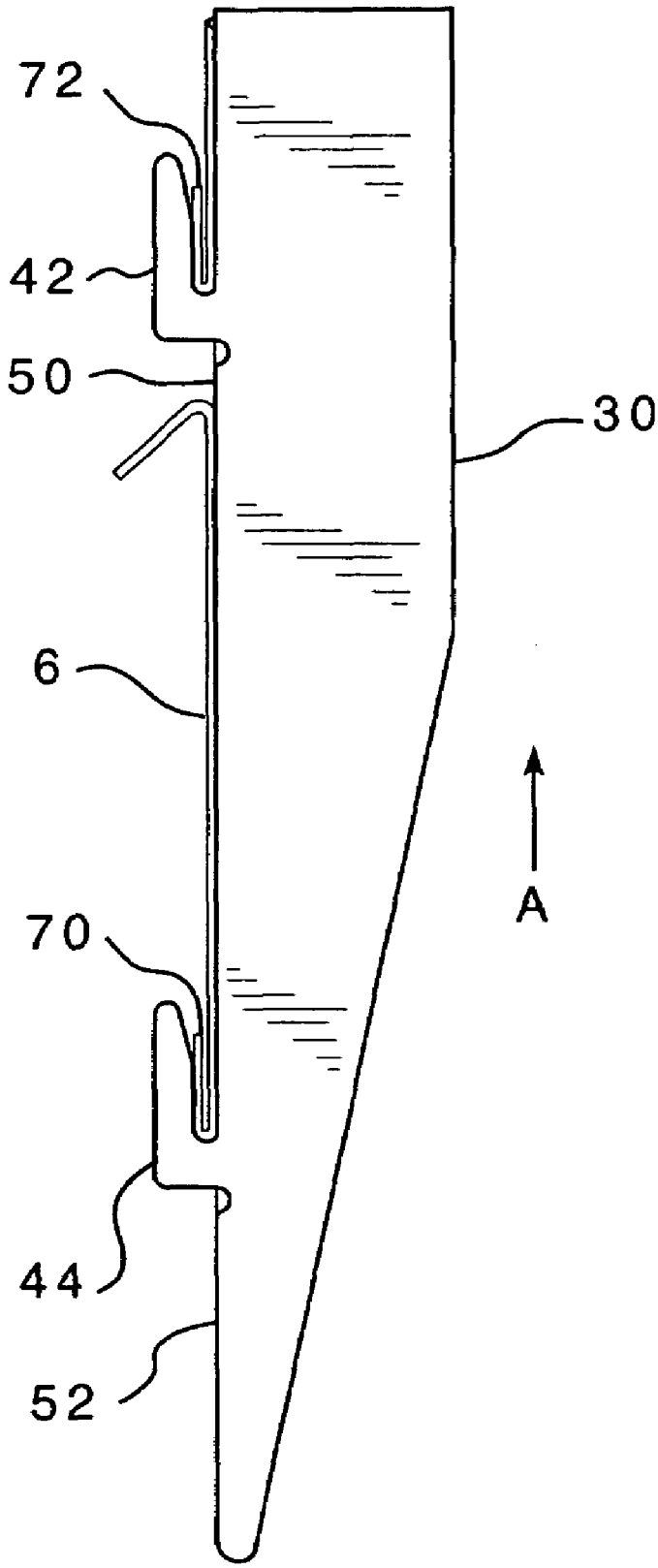
FIG. 9 is a partially schematic fragmentary view showing intersecurement between an anchor fin and a lower portion of the mailbox post of the present invention.

Referring to FIG. 9 there is shown a fin 30 in interengagement with the lower portion 6 of the support member 2 with finger 44 extending into the slot 52 and finger 42 extending into slot 50. Insertion may be effected through the respective slits 50, 52 and relative movement established to move the anchor fin 30 in the direction indicated by arrow A thereby folding the uppermost of the pair of tabs 61, 62, for example, to establish a reentrant portion 70 and thereby reinforce the opening or slot 52. The same is true with respect to reentrant portion 72 adjacent to finger element 42.

It will be appreciated that as the post is urged into the earth the taper will facilitate entry by the support member 2 into the earth and will tend to urge the fingers such as 42, 44 into more intimate engagement within the respective slots 50, 52 thereby providing effective mechanical joinder therebetween.

The lower portion of the post preferably is tubular and has a cross-sectional area selected from the group consisting of round, square and rectangular.

It will be appreciated that while a preferred approach to attaching fins to the mailbox post has been disclosed and illustrated and involves fin tabs which are received within openings in the post, other means of securing fins to the post are within the scope of the present invention. For example, the fins might be secured to the post by mechanical fasteners or welding.

Figure 10:
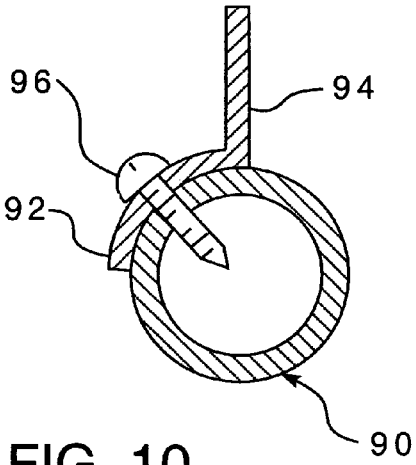
FIG. 10 is a schematic illustration of a modified form of fin post assembly secured by a mechanical fastener.

Referring to FIG. 10, there is shown a tube 90 to which a fin having a curved body portion 92 and a radially extending portion 94 is secured by means of a self-threading screw 96. It will be appreciated that a second, generally opposed similar fin might be attached to the post 90 in generally diametrically opposite position.

Figure 11:
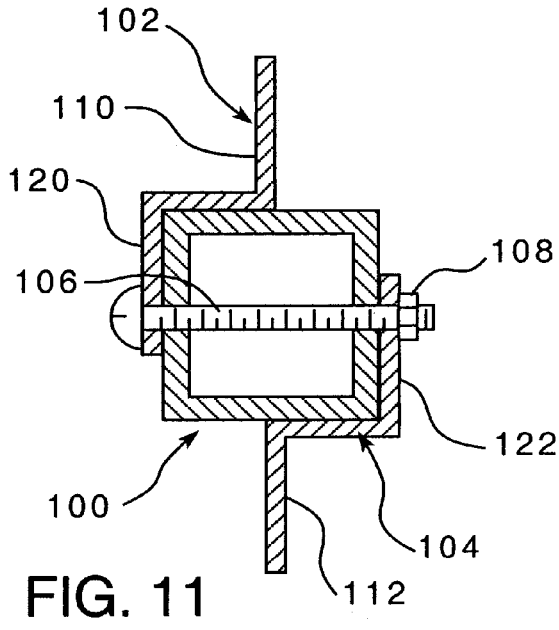
FIG. 11 is a schematic illustration showing a square post having a pair of fins secured thereto by mechanical fasteners.

Referring to FIG. 11, there is shown a post 100 which has a generally square, cross-sectional configuration and has a pair of fins 102, 104 secured to the post 100 by means of a bolt 106 which cooperates with a nut 108. As a result of the fins 102, 104 having projecting portions 110, 112, respectively, and anchoring portions 120, 122, respectively, a single bolt and nut may be employed to secure the assembly.

Figure 12:
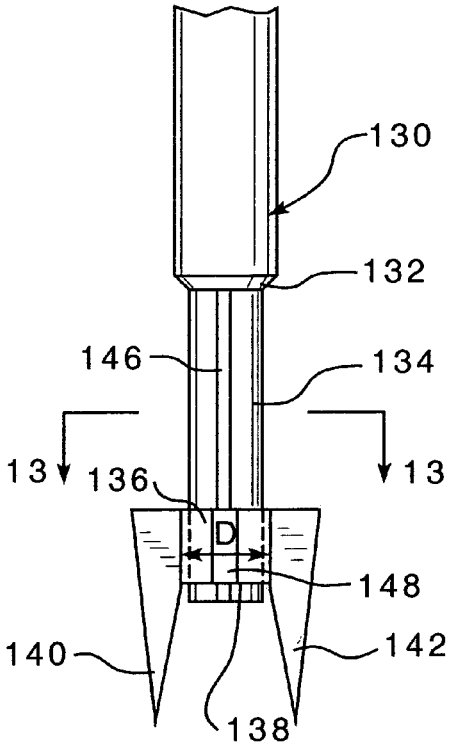
FIG. 12 is a fragmentary elevational view showing a form of reduced diameter lower post portion and a cooperating annular fin-containing member.
Figure 13:
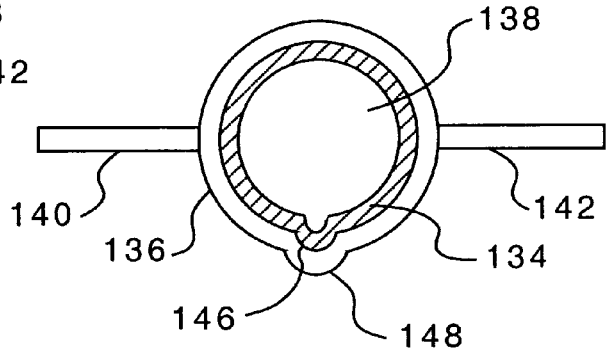
FIG. 13 is a cross-sectional view of the lower post portion taken through 13-13 of FIG. 12.

Referring to FIGS. 12 and 13, the tube 130 has a shoulder 132 and a reduced diameter portion 134 which is structured to be received within annular member 136 which has a central passageway 138 having an inner diameter D which is structured to receive the restricted portion 134 in friction-fit relationship. If desired, in addition to the friction fit, the assembly may be welded or otherwise secured through the use of mechanical fasteners or a suitable adhesive. A pair of radially projected fins 140, 142 is integrally formed or secured to the central collar 136. This embodiment has a further feature which contributes to enhanced interengagement between the tube 130 and the anchor 136 to resist relative rotation therebetween. A longitudinal radially outwardly projecting mail rib 146 is formed in the restricted portion 134 and is complimentary to and received within longitudinally oriented radially outwardly projecting and inwardly open female rib 148 formed with anchor 136 thereby providing the desired resistance to relative turning of the tube 130 with respect to the anchor 136. In a further refinement of this concept, it will generally be preferred to have a slight taper in the ribs 146, 148 such that a wedging action occurs as the tube 130 is moved downwardly into intimate contact with collar 136.

While for purposes of illustration two anchor fins 30, 32 (FIG. 1) and 102, 104 (FIG. 11) have been shown it will be appreciated that while not preferred a single fin (FIG. 10) could be employed or more than two fins could be employed. It is generally preferred that when a plurality of fins are employed that the circumferential distance between adjacent fins be generally equal for each of the fins and the next adjacent fin.

It will be appreciated that the present invention provides an effective economical and simple means for stabilizing a support post for a mailbox, such as a rural mailbox. This is accomplished in a simple manner through mechanical joinder with the final product resisting undesired rotational movement of the post or other undesired movement thereby facilitating the desired maintaining the generally vertical orientation of the post.

Whereas particular embodiments of the present invention have been described herein for purposes of illustration, it will be evident to those skilled in the art that numerous variations of the details may be made without departing from the invention as set forth in the appended claims.

What is claimed is:

1. A mailbox support comprising an elongated support post, a mailbox support arm secured to an upper portion of said support post for supporting a mailbox, at least one anchor fin secured to a lower portion of said support post and projecting outwardly therefrom, wherein said at least one anchor fin has a plurality of spaced upwardly projecting fingers which are structured to extend into said support post, wherein at least one of said projecting fingers is structured to be engaged with a portion of said support post by providing at least one tab on said support post which is structured to be folded in interengagement with said at least one of said projecting fingers.

2. The mailbox support of claim 1 including a pair of said anchor fins projecting generally radially outwardly from said support post.

3. The mailbox support of claim 2 including said anchor fins being secured within openings in said support post.

4. The mailbox support of claim 3 including said anchor fins each having a pair of spaced upwardly projecting fingers which extend into said support post which are engaged with said portion of said support post.

5. The mailbox support of claim 4 including said portion of said support post engaged by said projecting fingers having a reentrant fold.

6. The mailbox support of claim 5 including each said anchor fin tapering generally downwardly.

7. The mailbox support of claim 6 including said anchor fins having a length of about 4 to 12 inches.

8. The mailbox support of claim 7 including said anchor fins having a thickness of about 5/64 to 5/32 inch.

9. The mailbox support of claim 6 including said anchor fins being made of metal or at least one material selected from the group consisting of metal high-strength thermoplastic and reinforced plastic.

10. The mailbox support of claim 6 including said openings in said support post being elongated generally vertically oriented slots.

11. The mailbox support of claim 6 including said anchor fins being made of at least one material selected from the group consisting of metal high-strength thermoplastic and reinforced plastic.

12. The mailbox support of claim 6 including said post upper portion being a separate element which is secured to said post lower portion.

13. The mailbox support of claim 4 wherein urging said support post into earth will urge said anchor fins and said support post into intimate interengagement.

14. The mailbox support of claim 1 including said lower portion having a tubular cross-sectional shape selected from the group consisting of round, square and rectangular.

15. The mailbox support of claim 1 including said fins tapering downwardly.

16. The mailbox support of claim 7 including said fin having a width at its upper portion of about ½ to 3 inches.

* * * * *